US007985719B2

(12) United States Patent
Ward

(10) Patent No.: US 7,985,719 B2
(45) Date of Patent: Jul. 26, 2011

(54) CUTTING AND LUBRICATING COMPOSITION FOR USE WITH A WIRE CUTTING APPARATUS

(76) Inventor: Irl E. Ward, Bethlehem, PA (US)

( * ) Notice: Subject to any disclaimer, the term of this patent is extended or adjusted under 35 U.S.C. 154(b) by 365 days.

(21) Appl. No.: 12/079,963

(22) Filed: Apr. 28, 2008

(65) Prior Publication Data

US 2009/0270293 A1 Oct. 29, 2009

(51) Int. Cl.
*C07C 55/02* (2006.01)
*C08G 63/00* (2006.01)

(52) U.S. Cl. ..... 508/506; 508/494

(58) Field of Classification Search ..... 508/506, 508/143, 494
See application file for complete search history.

(56) References Cited

U.S. PATENT DOCUMENTS 4,461,712 A * 7/1984 Jonnes ..... 508/507
6,602,834 B1 * 8/2003 Ward et al. ..... 508/506

* cited by examiner

*Primary Examiner* — Walter D Griffin
*Assistant Examiner* — Frank C Campanell
(74) *Attorney, Agent, or Firm* — John Lezdey

(57) ABSTRACT

The invention relates to a cutting and lubricating suspension composition containing gelatinous particles for cutting hard and brittle material with a wire saw. The composition contains an in situ partially neutralized polyelectrolyte and a glycol which suspends abrasive particles used in the cutting operation.

18 Claims, 2 Drawing Sheets

CUTTING AND LUBRICATING COMPOSITION FOR USE WITH A WIRE CUTTING APPARATUS

FIELD OF THE INVENTION

The invention relates to a novel cutting and lubricating composition containing gelatinous particles or "gel slugs" for use with an apparatus for cutting workpieces of hard and brittle material such as semiconductor ingots or other brittle materials, with abrasive particles in the form of a slurry and a wire saw.

DESCRIPTION OF THE PRIOR ART

For one of the major applications of the invention, the cutting apparatus, referred to as a "wiresaw" or "wire-web", usually comprises a row of fine wires arranged parallel to each other and at a fixed pitch. A workpiece is pressed against these fine wires having diameters in the order of 0.10-0.20 millimeters running in parallel with one another in the same direction, while a liquid abrasive suspension fluid is poured onto the moving wires as a liquid curtain supplied between the work-piece and the incoming wires, thereby providing an abrasive coating on the wire to cut the workpiece into wafers, disks or sliced parts by an abrasive grinding action. The liquid suspended abrasive particles are coated onto the moving "web" or wire through a circulation system which drops a "blanket-curtain" of the abrasive suspensions onto the "web" just before the wire-web impacts the workpiece. Thus, the abrasive particles carried by the liquid are transferred via the coated wires to produce a grinding or cutting effect. The above described slicing units or machines, called wiresaws, are described in U.S. Pat. Nos. 3,478,732; 3,525,324; 5,269,275; and 5,270,271 which are incorporated by reference.

U.S. Pat. No. 6,602,834 to Ward et al discloses a cutting and lubricating composition which provides electrostatic and steric repulsion between abrasive particles using an ionized surfactant. The described compositions are free of gel slugs.

U.S. Pat. No. 5,099,820 issued to Stricot discloses an abrasive liquid as a suspension of particles of silicon carbide in water or oil. However, these prior art suspensions are not stable and do not provide uniform coating on the "cutting" wires. Furthermore, the compositions require vigorous agitation to maintain uniform suspension of the particles, and the suspension settles out quickly under stagnant conditions and even during workpiece slicing while still under agitation.

Thus, there exists a further need for a novel cutting and lubricating composition which provides a uniform supply of homogeneously dispersed abrasive material without abrasive particle agglomeration or "hard-cake" formation from suspension fall-out over a long term so that the workpiece is more efficiently and consistently cut by the abrasive particles or grit in the composition. Further, the composition should have excellent lubricity and heat transfer properties to remove the frictional heat generated at the cutting site thereby increasing working life of the wire and avoiding downtime. Finally, the composition should provide a long term stable suspension of abrasive particles.

SUMMARY OF THE INVENTION

According to the broadest aspect, the present invention relates to a cutting and lubricating composition for use with an apparatus for cutting workpieces of a hard and brittle material such as semiconductor materials, solar materials, optical and opto-electronic materials, silicon ingots, granite block, LED substrates, and the like. Further, such compositions are effective and useful for the precision cutting and grinding of specialty materials or ceramic parts as components for specialty tools, automotive, machine or other type devices. Other applications of this invention can be easily conceived by those skilled in the art when the suspension benefits of this invention provide advantageous performance results, such as in the grinding or slicing of hard substrates. More specifically, the lubricating composition, which may contain up to about 70% (wt/wt) of an abrasive material preferably, comprises the steps of admixing at a temperature below about 35° C.

a) about 0.0 to 10% by weight of a non-ionic surfactant
b) about 80 to 99 weight percent of a polyalkylene glycol having 2-5 carbon atoms or the co-glycols thereof, and
c) about 0.3 to 6% weight percent of an organic ionic polyelectrolyte and then partially neutralizing the polyelectrolyte with an appropriate Bronsted base to a pH of about 4.0 to 5.5 so as to form gelatinous micro-particles. A preferred polyelectrolyte is polyacrylic acid-co-maleic acid (PACM), though homopolymers or other co-polymers of similar properties and structure will also function.

It is an object of this invention to provide a cutting and lubricating composition which allows for the uniform distribution of the abrasive material to the coating of the cutting wire so that solids particle agglomeration or slurry fall-out does not occur.

Yet another object of the invention is to provide a cutting and lubricating composition wherein the abrasive cutting material is suspended in the composition and remains suspended without hard-cake formation or particle agglomeration even over long periods of stagnant storage.

A still further object is to provide high quality sliced sheets, wafers, disks or specialty shaped parts suitable for semiconductor and solar devices among other applications.

Other objects and applications for the composition invention and a more complete understanding of the invention will be had by referring to the following drawings and description.

DESCRIPTION OF THE PREFERRED EMBODIMENTS

Figure 1:
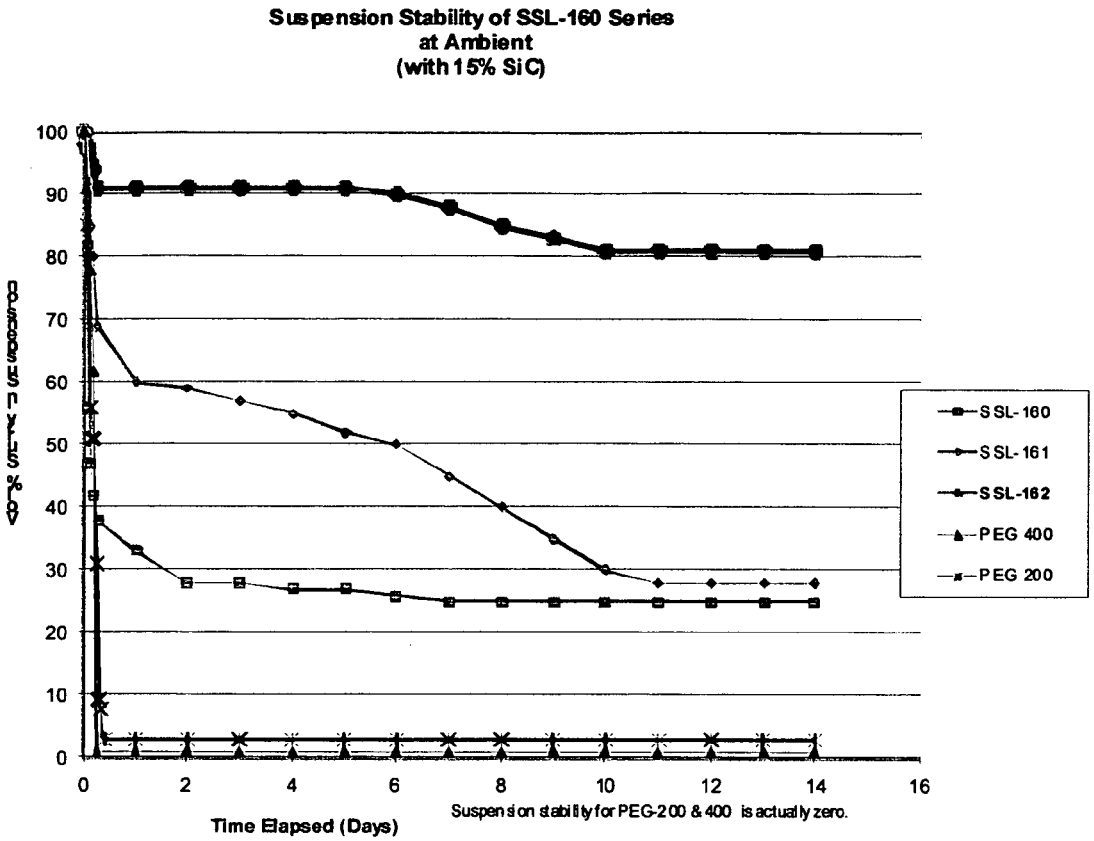
FIG. 1 illustrates the suspension stability of compositions of the inventions.

According to the present invention, a novel suspension and/or lubricating "carrier" composition increases the efficiency and productivity of abrasion-type slicing tools for slicing ingots made of brittle and hard material providing superior quality sliced components for semiconductor, optics, ceramic and photocell wafer or sheet substrates. The lubricating composition of this invention maintains abrasive particles in non-agglomerating suspension to allow a more uniform delivery of these abrasive particles to the cutting spaces which are formed between the wire and the workpiece, or alternatively, at both ends of the cutting portion, with the result that the machinery's slicing or cutting accuracy and efficiency are greatly improved. Also, the lubricating composition provides lubrication to the slicing wire and absorbs the frictional heat generated at the cutting surfaces. Thus, these features prolong the service life of the wire or braid and minimize any warping, roughness or thickness variation or sub-surface damage to the workpiece surfaces which deficiency cannot be tolerated in semiconductors, optical glass or photocell devices.

The lubricating/suspension "carrier" of the invention is prepared by the steps of admixing below at or below a temperature of about 35° C.

a) about 0.3 to 6% by weight of an organic ionic polyelectrolyte;

b) about 0.0 to 10% by weight of a non-ionic surfactant; and c) from about 80 to 99 weight percent of a polyalkylene glycol solvent, wherein the alkylene group contains 2-5 carbon atoms. Preferably, said glycols are selected from the group consisting of polyethylene glycol, polypropylene glycol, dipropylene glycol, polyisobutylene glycol and their co-glycols; and wherein said glycols consist of (on a total formulation weight percent basis) from about 80 to 99 weight percent of a glycol having a molecular weight of about 200-600, preferably of about 200-400, and most preferably of about 200-300, whereby the viscosity ranges from about 50 to 300 cps, and then partially neutralizing the polyelectrolyte to a pH of about 4.0 to 5.5 with a suitable Bronsted base so as to form gelatinous particles. A suitable Lewis base may also be used for the partial neutralization, through the formed gel slugs are not as well defined s with a Bronsted base, and the resulting particle slurry stability is somewhat compromised.

The abrasive material suitable for use in the above-recited composition may include diamond, silica, tungsten carbide, silicon carbide, boron carbide, silicon nitride, Cerium oxide, aluminum oxide or other hard grit "powder" material. One of the most preferred abrasive materials is silicon carbide. Generally, mean or peak particle sizes range from about 5-50 microns; and preferably from 8-20 microns, depending on the international "FEPA or JIS" grade designations and on the application of the abrasive slurry to a specific cutting or grinding process.

Most preferably, according to the present invention is provided a neutralized lubricating carrier composition to a pH between 4.0 and 5.5 which comprises:

a) about 93.5 to 99 weight percent of one or more polyethylene glycols wherein said polyethylene glycols consist of a molecular weight of from about 200 to 400; and whereby the viscosity of the composition is about 50-300 cps under room temperature conditions (25° C.), b) about 0.3 to 6% by weight of polyacrylic acid-co-maleic acid (PACM) at a molecular weight range of about 1500 to 5000, and c) about 0.3% by weight of a non-ionic surfactant.

Preferably the PACM is partially neutralized with tetramethyl ammonium hydroxide (TMAH) to a stoichiometric amount to produce a final pH within the above range.

Examples of the organic polyelectrolytes (anionic PE) suitable for use in the invention include but are not limited to pH partially neutralized polymers of:

acrylic acid;

methacrylic acid;

maleic acid alkenyl sulfonic acids aromatic alkenyl sulfonic acids (i.e.: styrene sulfonic acid for example)

alkylacryloxy sulfonic acids (i.e.: 2-methacryloxyethylsulfonic acid for example)

acrylamidosulfonic acids, and the like co-polymers of combinations of the above or other suitable monomer units.

Preferred polyelectrolytes include polyacrylic acid (PAA) having a molecular weight of about 1,000-10,000, polyacrylic acid-co-maleic acid (PACM) having a molecular weight of about 1500-8000 and the like. The "non-neutralized" form of the above polyelectrolytes (i.e.: anionic PE in the free acid state) do not function in this invention and have been shown not to enhance the Soft-Settle characteristics of PEG suspensions of SiC. Only the partially "neutralized" form of the anionic PE or electrolyte will properly function to form the required gel-slugs or miscible gelatinous particles.

The required gelatinous particles produced at a temperature below about 35° C. by the in situ neutralization of the example PACM within the PEG medium exist primarily because of the "effective" charge difference of the example PACM from the surrounding PEG environment. The neutralized example PACM polymer chains are highly ionic in nature, existing within an essentially non-aqueous, somewhat polar, but non-ionic PEG medium. It is of note that the PEG environment necessarily contains from about 0.5-5% water within the PEG media. This water provides an assisted polar environment within which the gel slugs exist in a stable form. Water content beyond ~15-20%, however, will begin to dissolve the gel slugs, compromising the slurry stability and soft-settle properties created from the carrier of the present invention. Since highly ionic species tend to coalesce within a non-ionic or lower-polarity medium, the neutralized PACM polymer chains will also tend to agglomerate-locally within the PEG medium into a localized area of separate composition and ionic character from the surrounding PEG medium.

Since the PEG is somewhat polar in nature, but not ionic, there will also be interaction of the partially neutralized example PACM carboxyl groups with the polar sections of the PEG polymer chains (i.e.; fractional miscibility) creating a "gelatinous particle", which is akin to a swelled polymer within a solvent, but not dissolved, and is of different composition and different ionic character than the surrounding PEG medium. This different ionic character is necessary for the example PACM "gel-slugs" to properly form. The high ionic nature of the example PACM gel-slugs is also evidenced by the rapid and complete solubility of said gel-slugs in excess water.

The concentrations of the abrasive material in the suspension medium typically may range from about 5 to 70 weight percent, preferably about 20 to 55 weight percent, and most preferably about 35-50 weight percent for most high volume applications.

Additional polar solvents, which can be included and which are useful as suspension or dispersing agents include alcohols, amides, esters, ethers, ketones, glycol ethers or sulfoxides. Specifically, examples of polar solvents are dimethyl sulfoxide, dimethyl acetamide (DMAC), N-methylpyrrolidone (NMP), gamma butyrolactone, diethylene glycol ethyl ether, dipropylene glycol methyl ether, tripropylene glycol monomethyl ether and the like.

Another component of the present invention involves the combination of different polyethylene glycols (PEG) as the medium within which the "gel-slugs" are formed in the present invention. The PEG base may comprise about 50 to 99 weight percent of the 200-300 preferred molecular weight PEG (based on total formulation weight percent) and about 1 to 50 weight percent of a PEG having molecular weight range from about 300 to about 1500 (based on total formulation weight percent) The higher molecular weight PEG must be soluble in the lower molecular weight base PEGs within all mixed proportions. Such mediums comprising mixtures of PEGs or other glycols will result in a lubricating, partially neutralized carrier of the present invention of high viscosity.

This may be advantageous for certain grinding or other applications known to those skilled in the art.

Preparation of Carrier

PACM, as an example of an appropriate polyelectrolyte material mentioned herein, must be partially neutralized within the PEG medium for the required gel-slugs to form properly. If neutralized outside the PEG within the water medium from which both the base and the example PACM originate, followed by addition of the neutralized PACM to the PEG, the micro gel-slugs primarily responsible for stabilizing the abrasive particles within the carrier do not form either properly or at all, and the carrier material will not function properly.

The example PACM must be added to the PEG medium first with mixing to provide a homogeneous dispersion, followed by neutralization with the appropriate base to the required pH of about 4.0-5.50. By adding the base first, followed by the example PACM, a variable level of neutralization of the example PACM chains occurs giving rise to a variable level of ionic character for the neutralized example PACM. As a result of this, gel-slug formation within the PEG medium will also vary and performance of the resulting system will be variable and inconsistent. It is highly desired that the example PACM polymer chains be neutralized homogeneously, which is most suitably accomplished with the example PACM added to the PEG first, and under constant agitation when the Bronsted base is added.

For the required gel-slugs to properly form, the neutralized pH for the PACM within the PEG medium must be at least about 4.0. Much lower than this does not neutralize enough of the example PACM to create the high ionic character needed to form the localized ionic gel-slugs within the PEG solvent.

With added base beyond the neutralization point (i.e.; pH ~/≧6), excess ionic material is being added to the low-ionic PEG medium, diminishing the ionic strength difference ($\Delta\mu$) between the localized example PACM chains and the surrounding PEG/water medium. This reduction in $\Delta\mu$ reduces the gel-slug formation, which relies, in part, on a significant difference in ionic character of the neutralized example PACM vs. the PEG/water medium (ie: high $\Delta\mu$ value).

It has been clearly established through comprehensive testing that the carrier functions to maintain abrasive particle suspension only when the required physicochemical "gel-slugs" are properly formed, irrespective of any electrostatic or Zeta-Potential repulsion contribution.

Gel-slug formation can be both seen visually and measured. The degree of product cloudiness (i.e.; turbidity) determined on visual inspection has been a semi-quantitative indicator of stabilization performance. A more quantitative tool known as a nephelometer may be used to numerically and precisely determine the product cloudiness and, therefore, the relative number and density of stabilizing gel-slugs.

Figure 2:
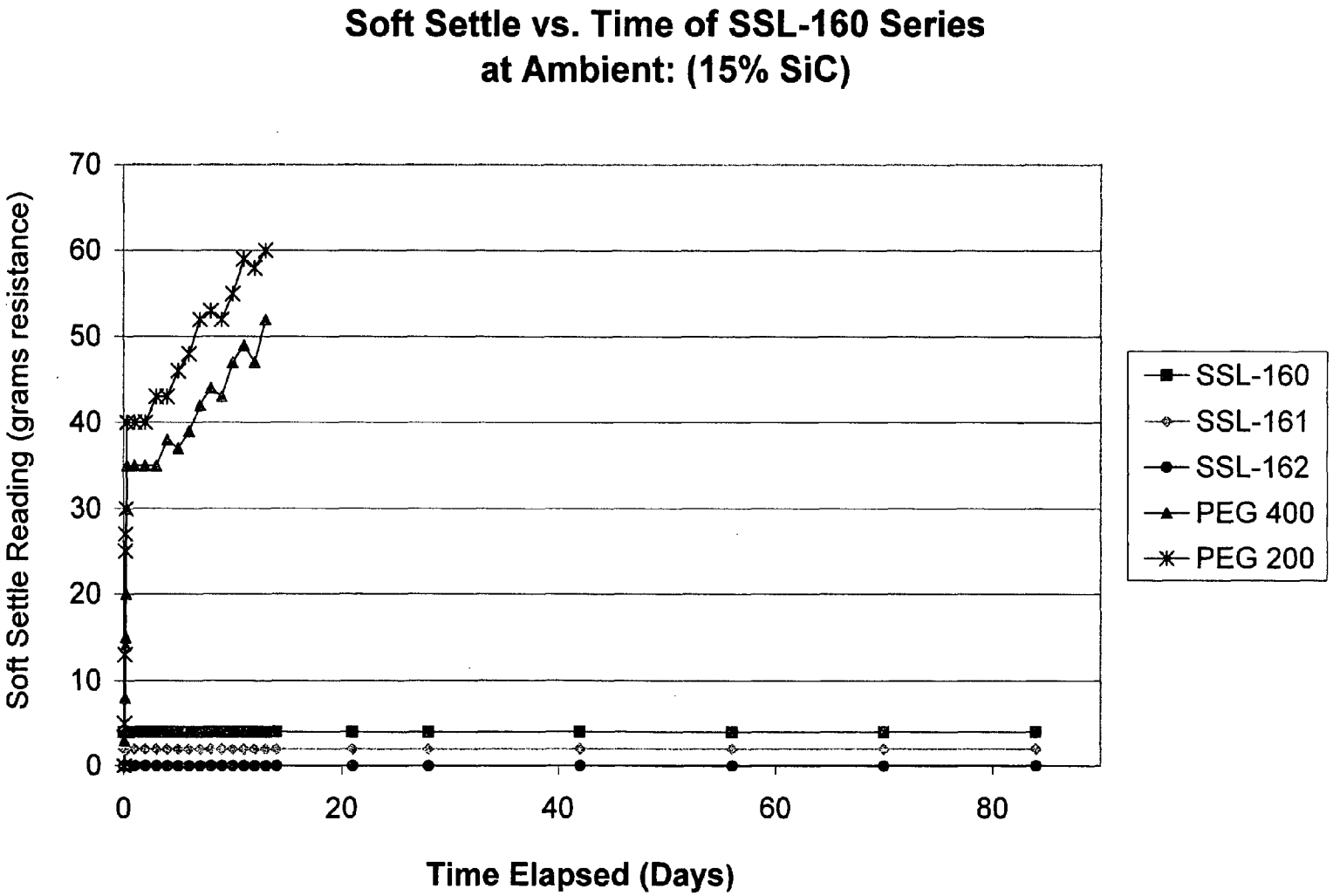
FIG. 2 illustrates the soft settle properties of compositions of the invention.

The performance of the carrier is measured by employing two quantitative measurement tools:

i) SSR (Soft-Settle Reading). This procedure measures in grams or lbs the resistance of a standard shaft with a circular bottom of known diameter and surface area to penetration through a standard prepared slurry placed in a standard conical bottomed tube where the cone bottom is of the same diameter as the circular bottom of the immersed shaft. The lower the resistance to shaft penetration over time, the more stable the slurry. Such measurements are made in a calibrated tool manufactured by "IMADA". For properly prepared composition of the present invention, the SSR reading for standard slurry over a period of several weeks remains at "0". This is in sharp contrast to improperly prepared composition which appears clear rather than cloudy, and which will give an SSR value of >0 after only several hours to a few days. Further, such tests performed on straight PEG-200 and PEG-400 slurries produce an SSR reading of >0 after only several hours to one day as seen in FIG. 2.

ii) SVR (Slurry Volume Remaining). This procedure measures the rate of solids settling over time from an original homogeneous slurry in which the solids dispersion occupies 100% of the volume of the liquid slurry. In an unstable slurry, the volume occupied by the suspended particles (SVR) falls rapidly, as the solids agglomerate and fall out of suspension forming a hard cake at the bottom of the container. This property of slurries can be easily plotted over time. Further, the particles in slurries not of the present invention that "fall" out of suspension form a hardened cake at the bottom of the container, which can be measured by the SSR procedure. In properly prepared compositions of the present invention, the SVR values fall much slower, and finally equilibrate at a % volume that is much higher than that for unstable slurries. Further, the SSR associated with such SSL slurries always reads at "0" regardless of the SVR reading or time as seen in FIG. 1.

In the attached figures, "Suspension vs. Stability for SSL-160 Series Product" (i.e.; SVR graph) and "SSL-160 Series Soft-Settle vs. Time", the level of suspension of "soft-settled" slurry is increased with increased neutralized PACM component level (i.e.; SSL-162>SSL-161>SSL-160>>>PEG); SSL being the assigned name for the carriers of the present invention. With increased partially neutralized PACM component level, there is an increased concentration of "gel-slugs" within the SSL medium, and therefore a greater resistance toward settling or even falling of abrasive particles within the slurry over time.

In the SSL-162, there is a high level of partially neutralized example PACM, and also a high level of carrier turbidity. This turbidity arises from the refraction and diffraction of light by the localized "gel-slugs" produced by the partially neutralized example PACM. The gel-slugs have a particle density slightly larger than that of the surrounding PEG-200 medium.

The anionic polyelectrolytes can be neutralized by alkali metal or alkaline earth metal bases such as potassium hydroxide or barium hydroxide or by non-metallic alkyl ammonium hydroxides, for example, tetraalkylammonium hydroxide, preferably, tetramethyl-ammonium hydroxide (TMAH).

The non-metallic hydroxides are preferred when maximum gel-slug formation at a given neutralized PACM concentration is desirable.

The following examples are illustrative of the practice of the method of the present invention. It will be understood, however, that the listed examples are not to be construed in any way limitative of the full scope of the invention since various changes can be made without departing from the spirit and concepts of the teachings contained herein in light of the guiding principles which have been set forth above. All percentages stated herein are based on weight except where otherwise indicated.

Example 1

Preparation of Carrier

To 8.9 Kg of low water PEG-200, which is under effective stirring, is added 0.21 Kg of a 50% aqueous solution of polyacrylic-co-maleic acid at a temperature of 25° C. The mixture is stirred to a homogeneous dispersion.

To the stirring mixture is slowly added either 0.25 Kg of a 25% aqueous solution of tetramethyammonium hydroxide solution (i.e.; TMAH) or an effective amount of TMAH to bring the pH of the total mixture to 5.0.

Optionally, a non-ionic surfactant such as a polymethyl siloxane (i.e.; examples of which include FC-99 or SAG-2001) may be added to optimize surface tension, minimize foaming, and improve wet-ability of the above neutralized mixture.

The composition can be used in a wire cutting operation as the suspension medium to provide a stable slurry suspension for weeks or months under even stagnant storage conditions.

Example 2

Preparation of Carrier

To 9.1 Kg of low water PEG-200, which is under effective stirring at ambient temperature is added 0.13 Kg of a 50% aqueous solution of polyacrylic acid of peak molecular weight of about 3500. The mixture is stirred to a homogeneous dispersion.

To the stirring mixture is slowly added either 0.12 Kg of a 25% aqueous solution of barium hydroxide solution, or an effective amount to bring the pH of the total mixture to 5.0.

Optionally, a non-ionic surfactant such as a polymethyl siloxane (i.e.; examples of which include FC-99 or SAG-2001) may be added to optimize surface tension, minimize foaming, and increase wet-ability of the above neutralized mixture.

The composition with an effective amount of suspended silicon carbide abrasive particles of desired particle size distribution can be used to cut silicon ingots in a wire saw.

Example 3

Compositions used in FIGS. 1 and 2 with 15% w/w of SiC

| Ingredient | SSL-160 | SSL-161 | SSL-162 |
|---|---|---|---|
| 1. % Polyelectrolyte (PACM) (PACM as a 50% aq. solution) | 0.70 | 1.5 | 2.4 |
| 2. % Base (TMAH) (TMAH as a 25% aq. solution) | 0.79 | 1.68 | 2.85 |
| 3. Non-ionic Surfactant (FC-99 as a 100% liquid) | 0.3 | 0.35 | 0.35 |
| 4. PEG-200 | 98.21 | 96.47 | 94.4 |

To quantitatively determine the level of "soft-settle" characteristics of a SiC slurry, a precise measurement tool was designed and constructed by PPT Research chemists and engineers. The operation and concept of this tool is explained above. In review, the "Soft-Settle Tool" essentially measures the resistance (in grams) to slurry penetration of a blunt-ended shaft down to a predetermined depth or distance from a standard configuration shaped container bottom. A special conical-shaped standard tube is used to exacerbate the "hard-settle" propensity of the slurry, thereby distinguishing a "good" suspension carrier from a poor one. The tube contains a standard level of 15% abrasive (SiC). The level of abrasive chosen is partially arbitrary, but represents a level for good visual observation of the solids settling process, and is a level for convenient tool measurement. 15% abrasive content by weight is such a level.

So that the tool measures "cake-penetration resistance" in a repeatable and precise manner, both standard rod penetration depth and calibration of the tool are checked daily. For a slurry formed within an acceptable suspension carrier, "Soft-Settle Readings" (i.e.; SSR) of penetration resistance are expected to be low; <25 g over long storage periods under controlled test conditions. For a slurry formed within an excellent suspension carrier, "Soft-Settle Readings" (i.e.; SSR) of penetration resistance are expected to be extremely low; 0 g over long storage periods under controlled test conditions. For slurries formed within poor suspension carriers (like standard PEG-200, 300 or 400, for example), SSR's are typically in the region of 35-50 g or higher within quite short "storage" time periods (i.e.; several hours to 1-2 days). In other words, the lower the SSR for a given slurry over time, the more stable, uniform, consistent and better the slurry.

What is claimed is:

1. A polar organic solvent based lubricating suspension carrier composition for use in cutting or slicing workpieces of a hard and brittle material with a wire saw, or other cutting or grinding tools prepared by admixing:

a) from about 0 to 10.0 weight percent of a non-ionic surfactant;

b) from about 80 to 99 weight percent of a polyethylene glycol or glycol having repeating units of 2-5 carbon atoms or the co-glycols thereof;

c) about 0.3 to 6 weight percent of an organic polyelectrolyte partially neutralized in situ to form gelatinous or gel micro-particles with a density slightly higher than that of the surrounding medium, and d) water.

2. The composition of claim 1 wherein said surfactant is a polyalkyl siloxane.

3. The composition of claim 1 wherein said partially neutralized polyelectrolyte is selected from the group consisting of a partially neutralized polymeric acid, partially neutralized amine and partially neutralized quaternary ammonium polymer.

4. The composition of claim 1 wherein said polyelectrolyte has a molecular weight between about 1000 and 1 million.

5. The composition of claim 1 wherein said polyelectrolyte is partially neutralized with tetraalkyl ammonium hydroxide.

6. The composition of claim 1 wherein said polyelectrolyte is partially neutralized with a metal hydroxide.

7. The composition of claim 1 wherein the polyethylene glycol is selected from the group consisting of PEG 200, PEG 300, PEG 400 and combinations thereof.

8. The composition of claim 1 comprising about 90% to 99 weight percent of at least one polyethylene glycol having a molecular weight of about 200 to 1000 and a polar solvent.

9. In a method for cutting workpieces of hard and brittle material with a wire saw, or other cutting or grinding methods, the improvement which comprises providing a lubricating suspension carrier composition with suspended gel particles or gelatinous microparticles according to claim 1.

10. The method of claim 9 wherein the lubricating suspension carrier contains abrasive particles suspended therein.

11. The method of claim 10 wherein said abrasive particles comprise a member selected from the group comprising silicon carbide, diamond, boron carbide, alumia, zirconia, cerium oxide, silica, quartz and tungsten carbide.

12. The method of claim 9 including as a suspension agent a polar solvent selected from the group consisting of alcohol, amides, esters, ethers, ketones, glycol ethers and sulfoxides.

13. The method of claim 12 wherein said polar solvent is selected from the group consisting of dimethyl sulfoxide, dimethyl acetamide, N-methyl pyrrolidone, and gamma butyrolactone.

14. The composition of claim 1 wherein said polyelectrolyte is an acidic polymer that forms an acidic amionic polyelectrolyte suspension agent upon neutralization.

15. The method of claim 14 wherein the solvent for the suspension agent is selected from the group consisting of diethylene glycol ethyl ether, dipropylene glycol methyl ether and tripropylene glycol monomethyl ether.

16. The composition of claim 1 wherein said partially neutralized polyelectrolyte is a basic cationic or acidic polyelectrolyte.

17. The composition of claim 16 wherein said basic cationic polyelectrolyte is neutralized with an acid selected from the group consisting of alkyl substituted propionic acid, polymethylacrylic acid, phosphoric acid and a hindered sulfonic acid.

18. The composition of claim 14 wherein said partially neutralized polyelectrolyte is an acidic anionic polyelectrolyte selected from the group consisting of polyacrylic acid, poly-methacrylic acid, polymaleic acid, co-polymers of acrylic acid, methacrylic acid, maleic acid, and mixtures thereof.

* * * * *